United States Patent [19]

Bennon et al.

[11] 4,176,333

[45] Nov. 27, 1979

[54] MAGNETIC CORE FOR SINGLE PHASE ELECTRICAL INDUCTIVE APPARATUS

[75] Inventors: Saul Bennon; William D. Albright, both of Muncie, Ind.

[73] Assignee: Westinghouse Electric Corp., Pittsburgh, Pa.

[21] Appl. No.: 914,463

[22] Filed: Jun. 12, 1978

[51] Int. Cl.[2] ..... H01F 27/08; H01F 27/26

[52] U.S. Cl. ..... 336/60; 336/92; 336/215

[58] Field of Search ..... 336/60, 84 R, 84 M, 336/92, 212, 214, 215, 216, 217

[56] References Cited

U.S. PATENT DOCUMENTS

| | | | |
|---|---|---|---|
| 2,698,924 | 1/1955 | Gordy | 336/215 |
| 2,812,505 | 11/1957 | Somerville | 336/217 X |
| 2,912,660 | 11/1959 | Graham | 336/215 |
| 3,571,772 | 3/1971 | Bennon et al. | 336/84 M |
| 3,614,696 | 10/1971 | Douglass | 336/215 |

*Primary Examiner*—Thomas J. Kozma
*Attorney, Agent, or Firm*—D. R. Lackey

[57] ABSTRACT

Magnetic core structure for single-phase shell form transformers. The magnetic core structure includes an outer magnetic core formed of a plurality of spaced legs joined at their corresponding ends to common yokes. Inner magnetic cores are disposed between the legs of the outer magnetic core and spaced therefrom to form gaps completely therearound. Double-webbed beams are positioned underneath the magnetic core structure to support the structure from the transformer tank. Each web extends into the gap between a leg of the outer magnetic core and the adjacent leg of one of the inner magnetic cores.

5 Claims, 4 Drawing Figures

MAGNETIC CORE FOR SINGLE PHASE ELECTRICAL INDUCTIVE APPARATUS

BACKGROUND OF THE INVENTION

1. Field of the Invention

This invention relates, in general, to electrical inductive apparatus and, more specifically, to single-phase power transformers.

2. Description of the Prior Art

Electrical inductive apparatus, such as large power transformers of the shell-form type, are conventionally constructed with two core loops placed side-by-side, with the electrical windings encircling the adjacent portions of the two core loops. A more effective utilization of core material may be obtained by using two winding assemblies disposed on a single core loop. However, when this construction is applied to high KVA ratings, severe heating of the tank walls is experienced adjacent the portions of the electrical windings not magnetically shielded by the magnetic core.

Several arrangements have been developed to reduce the heating in the tank walls which do not rely upon the placement of magnetic shielding laminations or bundles along the tank wall. U.S. Pat. No. 3,967,226, which is assigned to the assignee of this invention, discloses an arrangement wherein shielding magnetic core loops are located on each side of the main magnetic core of a single-phase shell-form transformer. The rectangular main magnetic core includes two concentric portions or loops which are spaced apart for cooling of the inner core laminations. Two shielding magnetic cores are positioned adjacent opposite ends of the main magnetic core and serve to direct much of the leakage flux away from the tank walls. Although such a structure provides adequate cooling of the core laminations and shielding of the tank walls, the support structure required to support the magnetic cores from the transformer tank experiences a non-uniform weight distribution due to its non-symmetrical configuration. The support structure includes a beam having a flange and two parallel web portions, with the web portions respectively extending into the gaps between adjacent legs of the main magnetic core and the outer magnetic shielding core loops. The length of one of the web portions of the support structure must be smaller than the length of the outer web portion to fit in the gap between the leg of the inner and outer portions of the main magnetic core. In addition, the web portions are not centered on the flange due to the difference in the widths of the main and shielding magnetic core loops which results in a non-uniform beam structure.

Thus, it would be desirable to provide a magnetic core structure having outer shielding core loops which has a symmetrical support structure for uniform weight distribution.

In recent years, there has developed a need in the electrical industry for single-phase transformers having higher and higher KVA ratings. Conventional magnetic cores, as described above, constructed to handle to higher KVA ratings may exceed the maximum rail shipping width clearance dimensions. It is known that the capacity or rating of a single-phase transformer may be increased without changing its width or height dimensions by adding additional core loops in line with the main magnetic core as shown in U.S. Pat. No. 1,765,483, which is assigned to the assignee of this invention. U.S. Pat. No. 3,156,886 discloses a similar arrangement in which the magnetic core includes at least six legs which are conected by common yoke members. However, the magnetic core shown therein is of the core-form type which differs significantly from shell-form magnetic cores since the winding legs of the magnetic core extend in the vertical direction instead of horizontal and thereby require a different support structure if a split-type core construction is to be utilized. In addition, at the higher ratings desired for single phase transformers, magnetic cores constructed by either of these arrangements may still exceed the maximum rail shipping width dimension.

Furthermore, it is impossible to add multiple core loops to the magnetic core structure shown in U.S. Pat. No. 3,967,226 due to the presence of the smaller shielding core loops and the requirement that all the magnetic core loops be of equal cross section, at the higher ratings, for uniform flux distribution.

Thus, it is desirable to provide a shell-form type power transformer wherein higher KVA ratings may be obtained without exceeding the maximum rail shipping width clearance dimensions. It is also desirable to provide a single-phase shell-form type power transformer wherein the magnetic core is constructed to provide adequate cooling of the internal core laminations. Finally, it is desirable to provide a shell-form type power transformer which utilizes outer magnetic core loop to direct the leakage flux away from the adjacent wall surfaces of the tank transformer.

SUMMARY OF THE INVENTION

Herein disclosed is a new and improved magnetic core structure for shell-form type power transformers which enables single-phase power transformers to be constructed with higher KVA ratings without exceeding the maximum rail shipping width clearance dimensions. The magnetic core structure includes a rectangular main or outer magnetic core having a plurality of parallel leg portions connected at their corresponding ends to common yokes. The leg portions are spaced apart to form apertures therebetween wherein a plurality of inner magnetic core structures, each formed of leg and yoke portions, are disposed. Such inner magnetic core is spaced from the main magnetic core to form a gap completely therearound for adequate cooling of the inner core laminations. By extending the yoke of the main magnetic core completely around the outermost inner magnetic cores, the overall width of the main magnetic core yoke laminations is reduced which enables a shell-form type power transformer to be constructed for higher KVA ratings which has a width less than the maximum rail shipping width clearance dimensions. Further, the outermost inner magnetic cores carry a portion of the magnetizing flux in addition to providing shielding of adjacent wall portions of the transformer tank.

A single-phase transformer may be constructed for higher KVA ratings with an overall width less than the maximum rail shipping width clearance dimension simply by adding additional inner magnetic cores is line with the other inner magnetic cores and extending the yokes of the outer magnetic core completely therearound. Thus, a single-phase shell-form type transformer may be constructed with higher KVA ratings than previously possible and still meet the maximum rail shipping width clearance dimension.

A novel support structure is provided at the bottom of the stacked laminations of the magnetic core to provide sufficient support for the laminations. The support structure includes a beam having a flange portion situated beneath the core laminations. Parallel web portions extend upwardly from the flange portion of the beam into the gaps between the leg portions of the main magnetic core and the adjacent leg portions of the inner magnetic cores. The web portions of the support structure are of equal length and are symmetrically disposed on the flange portion to form a support structure which provides better weight distribution than prior art beam configurations.

BRIEF DESCRIPTION OF THE DRAWING

The various features, advantages and other uses of this invention will become more apparent by referring to the following detailed description and drawing in which.

DESCRIPTION OF THE PREFERRED EMBODIMENT

Figure 1:
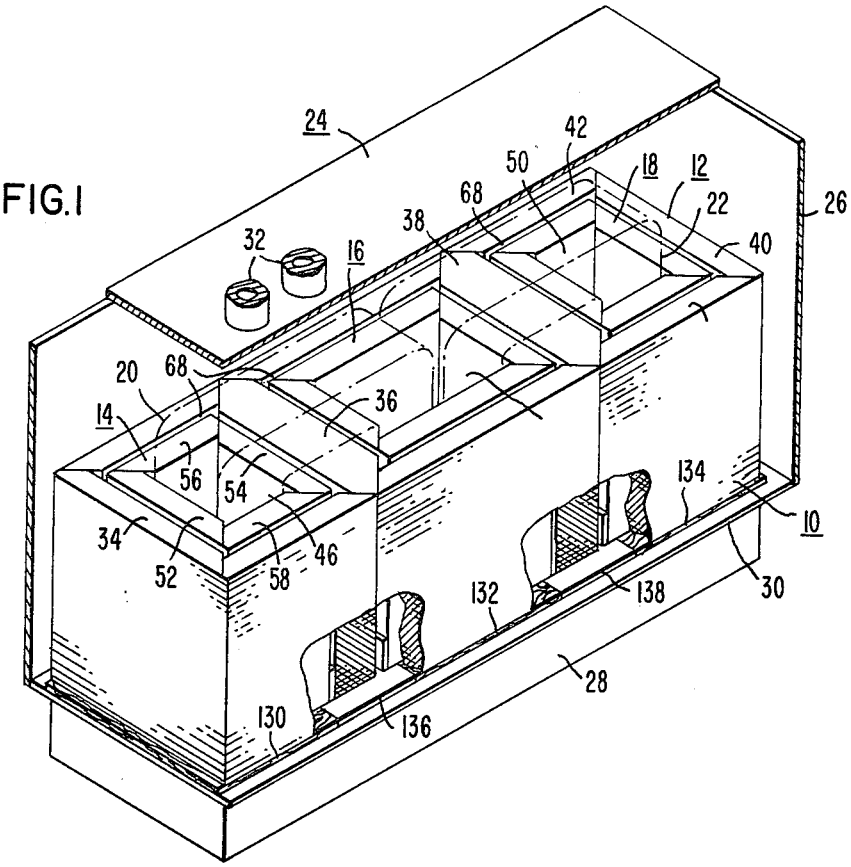
FIG. 1 is a perspective view, partially broken away, of a shell-form type power transformer constructed according to the teachings of this invention.

Throughout the following description, identical reference numbers refer to the same component shown in all figures of the drawing.

Referring now to the drawing, and to FIG. 1 in particular, there is shown a single-phase, shell-form type power transformer constructed according to the teachings of this invention. The transformer includes a magnetic core assembly 10 formed of a main or outer magnetic core structure 12 and inner magnetic core structures 14, 16, and 18. The magnetic core structures 12, 14, 16 and 18 are inductively coupled by an electrical winding assembly consisting of identical phase groups 20 and 22 which are connected in parallel for proper single-phase operation and which are shown in phantom in FIG. 1. Although other types of coil arrangements may be used, the embodiment disclosed herein illustrates the use of pancake-type coils for the electrical winding assembly. Furthermore, while a single-phase transformer is illustrated, it will be understood that the teachings of this invention apply equally as well to single-phase transformers which are connected for three-phase operation.

The magnetic core and electrical winding assembly is enclosed within a transformer tank 24 which includes side walls, such as side wall 26, and a bottom portion 28 which includes a horizontal supporting surface 30. The supporting surface 30 is used as the lower surface of the tank 24 from which the magnetic core and electrical winding assembly is supported. Although not shown in FIG. 1, normally a dielectric and cooling fluid, such as oil, is contained within the transformer tank 24 and covers the magnetic core and electrical winding assembly. The electrical bushings 32 are illustrative of a bushing which is attached to the transformer tank 24 for the purpose of connecting the electrical winding structure located within the tank 24 to an external electrical circuit.

Figure 2:
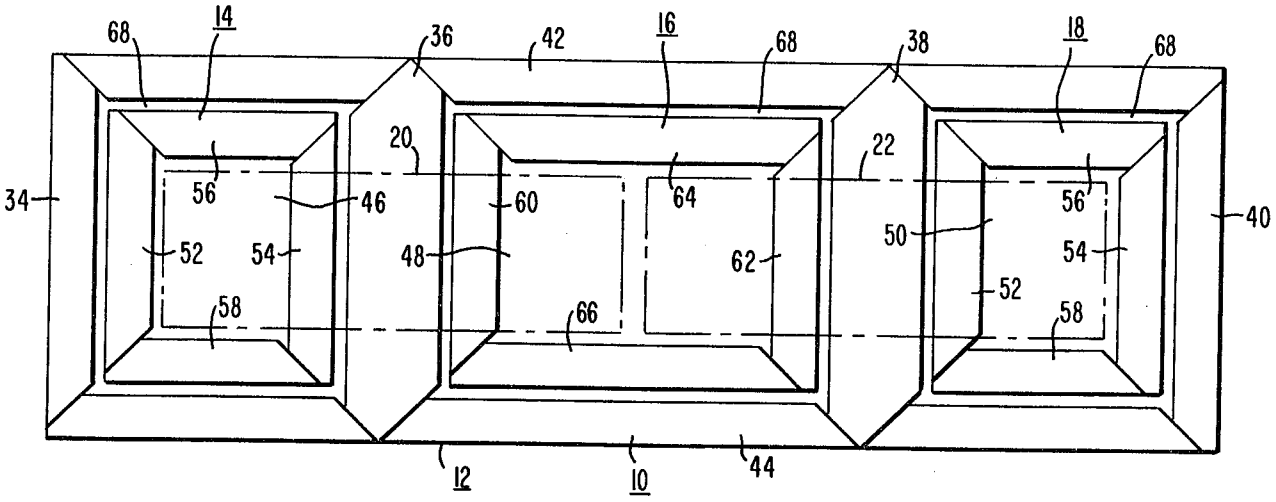
FIG. 2 is a plan view of the magnetic core and coil assembly shown in FIG. 1.

As shown in FIG. 1, and in greater detail in FIG. 2, the magnetic core structure 10 includes a main or outer magnetic core 12 having first, second, third and fourth parallel leg portions 34, 36, 38 and 40, respectively, whose corresponding ends are joined to the first and second yoke portions 42 and 44, respectively. The leg and yoke portions of the main magnetic core 12 are formed of stacked laminations of a suitable magnetic material, such as grain oriented silicon steel. Alternate laminations are disposed end-for-end to provide an overlap at each joint between the various punchings. In addition, the ends of the inner core legs 36 and 38 of the main magnetic core 12 have 45° mitered corners to tie into the first and second yoke portions 42 and 44, respectively. The first, second, third and fourth leg portions 34, 36, 38 and 40, respectively of the main magnetic core 12 are spaced apart to form first, second and third apertures 46, 48 and 50, respectively, therebetween.

The inner magnetic cores 14, 16 and 18 constructed of leg and yoke portions formed of stacked laminations of a suitable magnetic material. The outermost inner magnetic cores 14 and 18 are identically constructed and include leg portions 52 and 54 connected between yoke portions 56 and 58. The innermost inner magnetic core 16 includes leg portions 60 and 62 which are of the same width as the leg portions 52 and 54 of the outermost inner magnetic cores 14 and 18 and which are joined to yoke portions 64 and 66.

The inner magnetic core structures 14, 16 and 18 are respectively disposed within the apertures 46, 48 and 50 formed between the parallel spaced legs of the main magnetic core 12 and spaced therefrom to form gaps 68 which extend completely around the entire path length of each of the inner magnetic core 14, 16 and 18. The gaps 68 between the main magnetic core 12 and each of the inner magnetic cores 14, 16 and 18 allows sufficient cooling of the magnetic laminations to prevent excessive heat buildup near the center of the magnetic core structure 10 which would be a problem when a large magnetic core is constructed without sufficient means for allowing a coolant to flow through the magnetic core laminations.

Actually, the magnetic core structure 10 consists of a plurality of magnetic cores in which each inner magnetic core is aligned about the same central axis through the core opening with a portion of the outer magnetic core. The phase windings 20 and 22 are disposed around adjacent leg portions of the outer and inner magnetic cores such that the outer and inner magnetic cores form complete magnetic paths around a portion of the phase windings 20 and 22.

The outermost inner magnetic cores 14 and 18 and the portion of the main magnetic core 12 disposed therearound direct a large portion of the leakage flux away from the adjacent wall portions of the transformer tank 24 and thereby prevent excessive heating in this portion of the tank 24. In addition, by disposing a portion of the main core 12 around the outermost inner magnetic cores 14 and 18, these portions of the magnetic core structure are made to carry a portion of the magnetizing flux which enables the width of the yoke laminations of the main magnetic core 12 to be reduced over prior art magnetic cores of a similar type.

According to the preferred embodiment of this invention, the yokes 42 and 44, and the outermost legs 34 and 40 of the main magnetic core 12, as well as the leg and yokes of each of the inner magnetic cores 14, 16 and 18 each have a first width dimension. The inner legs 36 and 38 of the main magnetic core 12, on the other hand, have a width dimension twice that of the width of the remaining portions of the magnetic core structure 10. In this construction, the inner and outer magnetic cores have equal cross sections which provide uniform flux distribution throughout the magnetic core structure 12. Since the magnetizing flux flowing through the innermost legs 36 and 38 of the main magnetic core 12 divides equally as it enters the yoke portions 42 and 44. Although the above-described relationship between the widths of the various leg and yoke portions of the inner and outer magnetic core structures is preferred, it is exemplary only and is not intended to limit the relationship between the inner and outer core punching widths, which can be varied to suit a particular design or rating.

Figure 3:
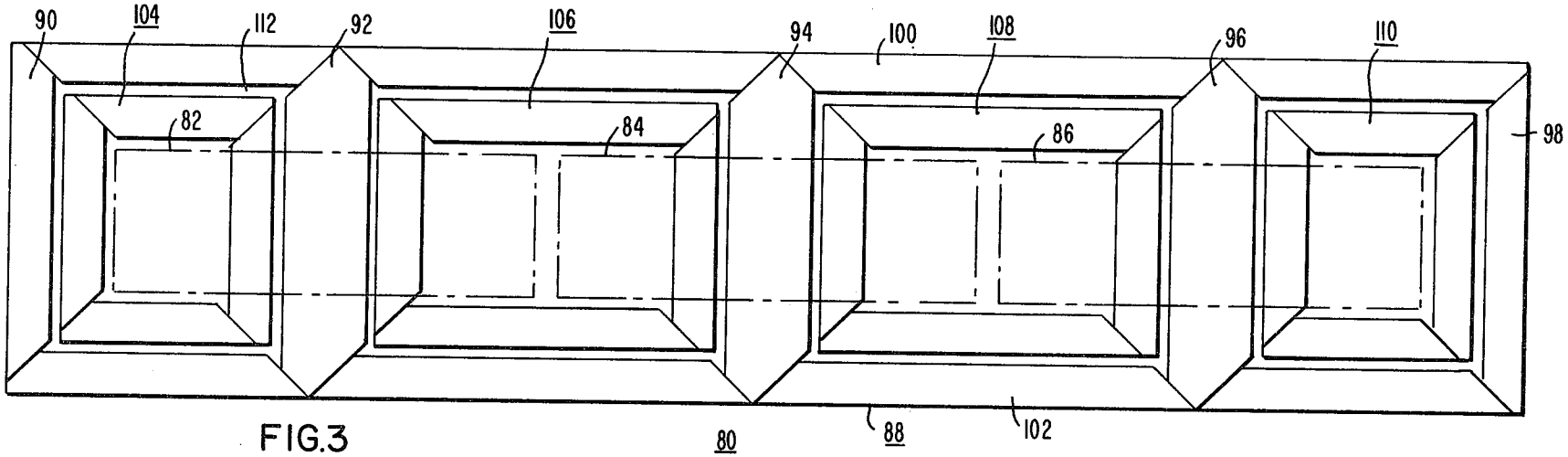
FIG. 3 is a plan view of a magnetic core and coil assembly constructed according to another embodiment of this invention.

The above-described magnetic core structure may be extended to include a magnetic core structure having n legs and n -1 inner magnetic cores to thereby provide a single-phase transformer having higher KVA ratings and at the same time maintain the overall width of the magnetic core within the maximum rail shipping width clearance dimensions. Referring now to FIG. 3, there is shown a magnetic core structure 80 constructed according to another embodiment of this invention wherein first, second and third phase windings 82, 84 and 86 are connected in parallel to provide the desired higher KVA ratings. The magnetic core structure 80 includes a main or outer magnetic core 88 having first, second, third, fourth and fifth parallel legs 90, 92, 94, 96 and 98, respectively, which are joined at their corresponding ends to first and second yokes 100 and 102, respectively. The leg portions of the main magnetic core 88 are spaced apart to form a plurality of apertures therebetween wherein first, second, third and fourth inner magnetic cores 104, 106, 108 and 110, respectively, are disposed. Each inner magnetic core 104, 106, 108 and 110 is spaced from the adjoining portions of the main magnetic core 88 to form a gap, such as gap 112, therebetween for coolant flow through the magnetic core laminations. The magnetic core structure 80 functions similar to the magnetic core structure 10, shown in FIG. 1 and 2, in that the outermost iner magnetic cores 104 and 110 and leg and yoke portions of the main core 88 surrounding them carry a portion of the magnetizing flux and, also, direct a large portion of the leakage flux away from the adjoining wall surfaces of the tank 24 of the transformer.

Thus, it can be seen that single-phase shell-form type power transformers having the magnetic core structure described above may be constructed with higher KVA ratings and at the same time have an overall width less than the maximum rail shipping width clearance dimension. Additional KVA capacity may be easily provided for such single-phase power transformers by extending the yoke portions and providing an additional inner magnetic core, similar to inner magnetic core 108, and an additional leg, similar to leg 96, in the main magnetic core 88 to thereby utilize an additional phase winding which is connected in parallel with the adjacent windings of the transformer.

Figure 4:
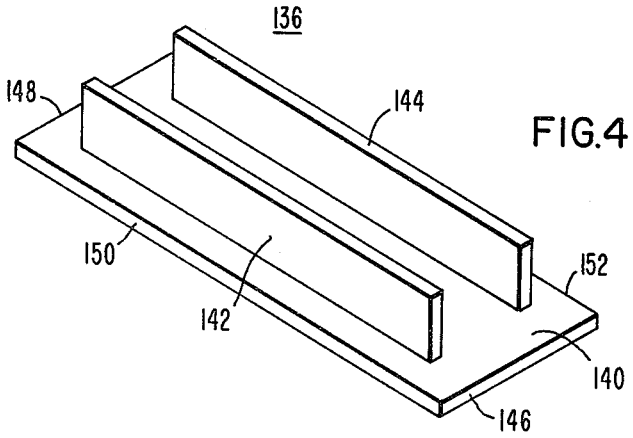
FIG. 4 is a perspective view of a support structure for use with a power transformer constructed according to the teachings of this invention.

Referring again to FIG. 1, the magnetic laminations which form the leg and yokes of the magnetic cores 12, 14, 16 and 18 inherently lack rigidity in the vertical direction due to their dimensions and orientation with respect to the vertical direction. For this reason, it is necessary to support the laminations by a structure which keeps the laminations from sagging or deforming under their own weight. The wood spacers 130, 132 and 134 separate the magnetic core laminations from the metallic transformer tank, but offer little in the way of overall support for the magnetic core laminations. Additional support structures 136 and 138 rest against the horizontal supporting surface 30 of the transformer tank 24 to provide the primary means for maintaining the straightness of the laminations of the magnetic cores. Referring now to FIG. 4, there is shown a perspective view of one of the identical support structures 136 and 138. The support structure 138 may be constructed of solid steel components or it may be constructed of laminated steel members in a manner known to those skilled in the art for reducing the heating of supporting beams located adjacent to magnetic cores. In addition, various openings or spaces in the support structure 136 may be used to aid the flow of a liquid dielectric through the magnetic core 10.

As can be seen in FIG. 4, the support structure 136 is essentially a beam member having a flange portion 140 which is located underneath the legs of the magnetic core structure 10 on the horizontal mounting surface 30 of the transformer tank 24. The support member 136 includes two parallel web portions 142 and 144 which extend vertically from the flange 140 of the support structure 136. The web portions 142 and 144 are spaced a predetermined distance apart so as to surround on of the inner core legs, such as inner core leg 36 of the main magnetic core 12 shown in FIG. 2, and thereby extend into the gap between the inner leg of the magnetic core 10 and the adjoining legs of the inner magnetic core structures, such as legs 54 and 60 of the inner magnetic core structures 14 and 16. The web portions 142 and 144 are of equal length and are spaced a predetermined distance from the ends 146 and 148 of the flange 140 of the support structure 36 so as to fit between the yokes of the magnetic core structure 10. Furthermore, the web portions 142 and 144 are disposed an equal distance from the laterally extending edges 150 and 152 of the flange 140 so as to form a symmetrical structure which provides uniform weight distribution.

Thus, it will be apparent to one skilled in the art that there is disclosed herein a single-phase power transformer having a reduced width dimension compared to prior art transformers of this type for a given KVA rating. The outer or main magnetic core completely surrounds the outermost inner magnetic core structures which enables the widths of the yokes of the outer magnetic core to be reduced which, in turn, reduces the overall width of the transformer. In addition, the outermost inner magnetic cores and the portion of the main magnetic core surrounding the same carries a portion of the magnetizing flux which provides a more uniform flux distribution throughout the entire magnetic core structure.

The magnetic core structure is provided with inner magnetic cores spaced from adjoining leg and yoke portions of the main or outer magnetic core structure to provide cooling of the inner core laminations. A uniform core structure results which may easily be extended to include additional phase winding groups to provide a single-phase power transformer having higher KVA ratings and still maintain the overall width of the magnetic core structure within the maximum rail shipping width clearance dimensions.

A symmetrical support structure for the magnetic cores is provided and includes a beam having a flange portion situated beneath the magnetic core structure and parallel web portions which extend into the gaps between adjoining legs of the inner and outer magnetic cores. The web portions are of equal length and are symmetrically disposed on the flange portion of the support structure to form a symmetrical support structure which provides uniform weight distribution.

What is claimed is:

1. Electrical inductive apparatus comprising:

an enclosure;

a first magnetic core structure disposed in said enclosure and having n parallel leg portions and first and second yoke portions formed of stacked metallic laminations, said n leg portions being spaced apart to form n −1 apertures therebetween;

n −1 second magnetic core structures, each having leg and yoke portions formed of stacked metallic laminations, each of said n −1 second magnetic core structures being disposed in one of said apertures in said first magnetic core structure and spaced from adjoining leg and yoke portions of said first magnetic core structure to form a gap completely therearound;

an electrical winding assembly disposed in inductive relation with said first and said n −1 second magnetic core structures; and at least one support member having a flange portion mounted on the bottom of said enclosure and two parallel web portions extending vertically therefrom, said two parallel web portions being of equal length with each web portion extending into the gap between one of said legs of said first magnetic core structure and an adjacent leg of one of said n −1 second magnetic core structures.

2. The electrical inductive apparatus of claim 1 wherein the outermost leg portions and the first and second yoke portions of the first magnetic core structure and the leg and yoke portions of each of the n −1 second magnetic core structures have a first width dimension and the inner leg portions of said first magnetic core structure having a width which is twice said first width dimension.

3. The electrical inductive apparatus of claim 1 wherein the second magnetic core structures are disposed substantially in-line and wherein the outermost ones of said second magnetic core structure are identically constructed.

4. Electrical inductive apparatus comprising:

an enclosure;

a first magnetic core structure disposed in said enclosure and having first, second, third and fourth parallel leg portions and first and second yoke portions formed of stacked metallic laminations, and first, second, third and fourth leg portions being spaced apart to form first, second and third apertures, respectively, therebetween;

second, third and fourth magnetic core structures, each having leg and yoke portions formed of stacked metallic laminations, said second, third and fourth magnetic core structures being respectively disposed within said first, second and third apertures in said first magnetic core structure with each of said second, third and fourth magnetic core structures being spaced from adjoining portions of said first magnetic core structure to form a gap completely therearound;

an electrical winding assembly disposed in inductive relation with said first, second, third and fourth magnetic core structures; and first and second support members, each of said first and second support members mounted having a flange portion mounted on the bottom of said enclosure with two parallel web portions of equal length extending vertically therefrom, said first and second support structures being disposed beneath said first, second, third and fourth magnetic core structures such that said web portions of said first support structure surround said second leg portion of said first magnetic core structure and are disposed in the gaps between said second leg portion of said first magnetic core structure and the adjacent legs portions of said second and third magnetic core structures and said web portions of said second support structure surround said third leg portion of said first magnetic core structure and are disposed in the gaps between said third leg portion of said first magnetic core structure and the adjacent legs portions of said third and fourth magnetic core structures.

5. The electrical inductive apparatus of claim 4 wherein:

the first and fourth leg portions and the first and second yoke portions of the first magnetic core structure and the leg and yoke portions of the second, third and fourth magnetic core structures, each have a first width dimension; and the second and third leg portions of said first magnetic core structure each have a width dimension twice said first width dimension.

* * * * *